US010391797B2

(12) United States Patent
Tanabe et al.

(10) Patent No.: US 10,391,797 B2
(45) Date of Patent: Aug. 27, 2019

(54) LIQUID EJECTING APPARATUS

(71) Applicant: SEIKO EPSON CORPORATION, Tokyo (JP)

(72) Inventors: Kentaro Tanabe, Nagano (JP); Kenji Kojima, Milan (IT)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/771,548

(22) PCT Filed: Oct. 28, 2016

(86) PCT No.: PCT/JP2016/004747
§ 371 (c)(1),
(2) Date: Apr. 27, 2018

(87) PCT Pub. No.: WO2017/073072
PCT Pub. Date: May 4, 2017

(65) Prior Publication Data

US 2018/0304653 A1 Oct. 25, 2018

(30) Foreign Application Priority Data

Oct. 30, 2015 (JP) ..... 2015-213579

(51) Int. Cl.
*B41J 25/00* (2006.01)
*B41J 2/08* (2006.01)
(Continued)

(52) U.S. Cl.
CPC ..... *B41J 25/006* (2013.01); *B41J 2/08* (2013.01); *B41J 2/17553* (2013.01); *B41J 29/02* (2013.01); *B41J 29/08* (2013.01); *B41J 25/308* (2013.01)

(58) Field of Classification Search
CPC ..... B41J 25/006; B41J 2/08; B41J 29/02
See application file for complete search history.

(56) References Cited

U.S. PATENT DOCUMENTS 6,139,132 A 10/2000 Yasukawa et al.
6,460,981 B1 10/2002 Yasukawa et al.
(Continued)

FOREIGN PATENT DOCUMENTS

JP 09-099557 A 4/1997
JP 2006-205689 A 8/2006
(Continued)

OTHER PUBLICATIONS

Machine translation of JP 2013_223987, published on Oct. 2013 (Year: 2013).*
The Extended European Search Report for the corresponding European Patent Application No. 16859310.1 dated May 10, 2019.

*Primary Examiner* — Huan H Tran

(57) ABSTRACT

A liquid ejecting apparatus which ejects liquid onto a medium includes a carriage which includes a control substrate configuring at least a part of a control unit which controls driving of the entire liquid ejecting apparatus, an ejecting unit which ejects the liquid, and a driving substrate which is connected to the control substrate and the ejecting unit, and drives the ejecting unit, in which the carriage is provided with a load absorbing unit which absorbs a physical load with respect to the ejecting unit from the driving substrate side. By adopting the liquid ejecting apparatus with such a configuration, it is possible to prevent a load from being applied to the ejecting unit from the driving substrate side.

8 Claims, 17 Drawing Sheets

(51) Int. Cl.

| | |
|---|---|
| ***B41J 29/02*** | (2006.01) |
| ***B41J 2/175*** | (2006.01) |
| ***B41J 29/08*** | (2006.01) |
| *B41J 25/308* | (2006.01) |

(56) References Cited

U.S. PATENT DOCUMENTS

| | | | |
|---|---|---|---|
| 6,729,002 | B1 | 5/2004 | Yasukawa et al. |
| 8,414,105 | B2 | 4/2013 | Komuro et al. |
| 2002/0140782 | A1 | 10/2002 | Yasukawa et al. |
| 2003/0193549 | A1 | 10/2003 | Yasukawa et al. |
| 2006/0170732 | A1 | 8/2006 | Yamada |
| 2011/0134182 | A1 | 6/2011 | Yang et al. |
| 2011/0141192 | A1 | 6/2011 | Komuro et al. |
| 2013/0162707 | A1 | 6/2013 | Kitaoka |
| 2014/0292938 | A1 | 10/2014 | Hagiwara et al. |
| 2018/0304654 | A1* | 10/2018 | Tanabe ..... B41J 29/02 |
| 2018/0345698 | A1* | 12/2018 | Tanabe ..... B41J 25/006 |

FOREIGN PATENT DOCUMENTS

| | | | |
|---|---|---|---|
| JP | 2011-116117 | A | 6/2011 |
| JP | 2011-121319 | A | 6/2011 |
| JP | 2012-125959 | A | 7/2012 |
| JP | 2013-223987 | A | 10/2013 |
| JP | 2014-094454 | A | 5/2014 |
| WO | 2014/162938 | A1 | 10/2014 |

* cited by examiner

[Fig. 1]
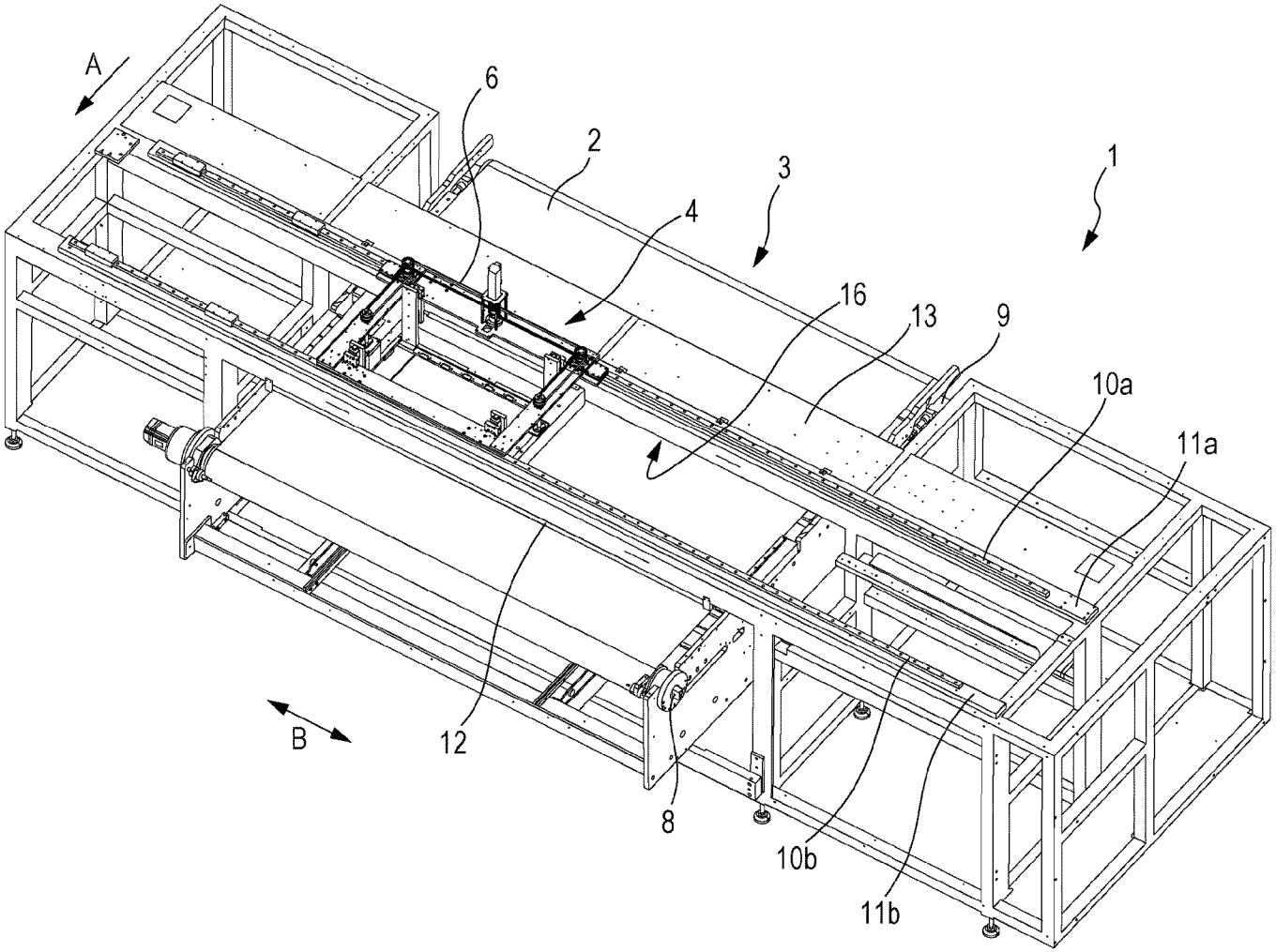

[Fig. 2]
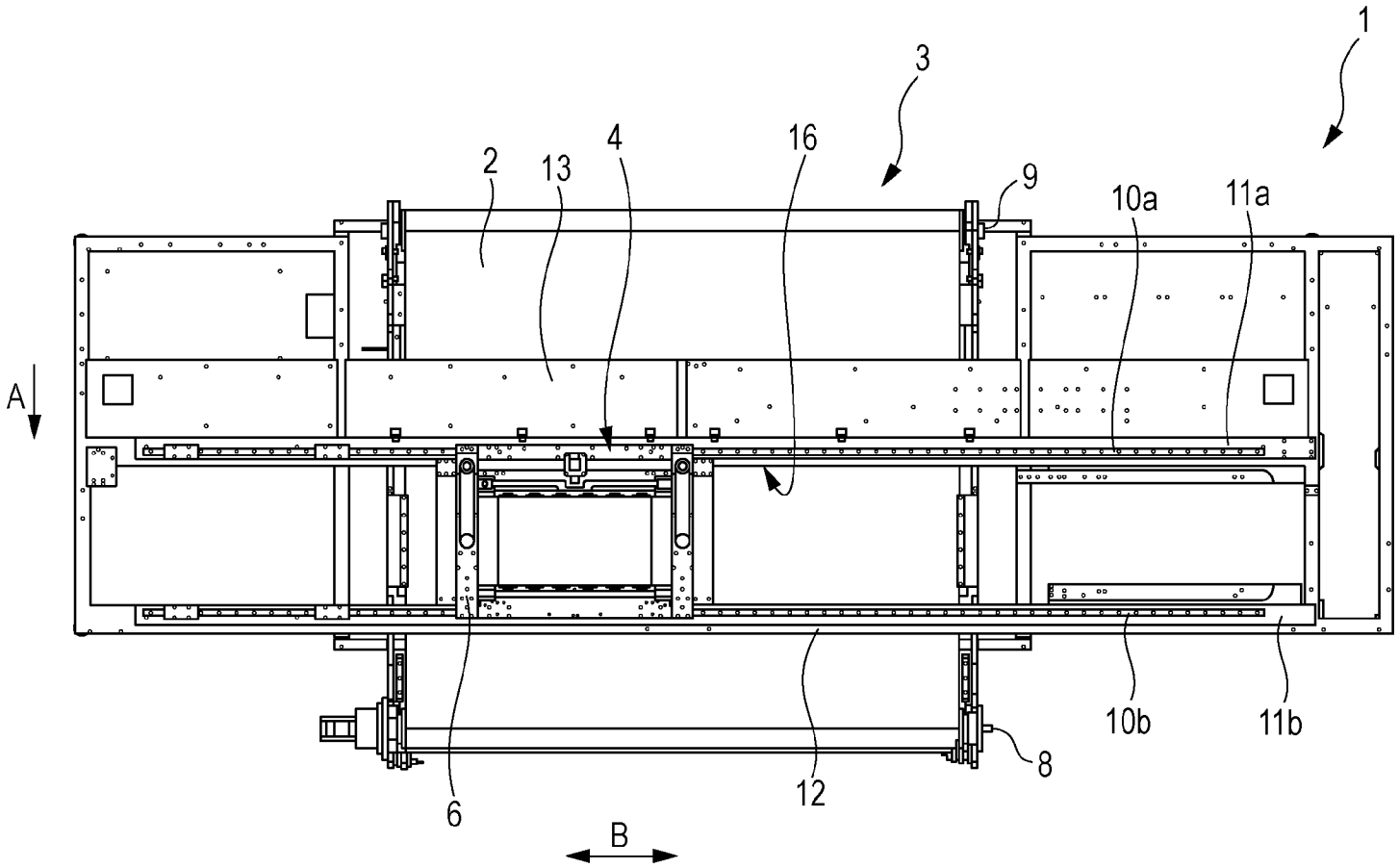

[Fig. 3]
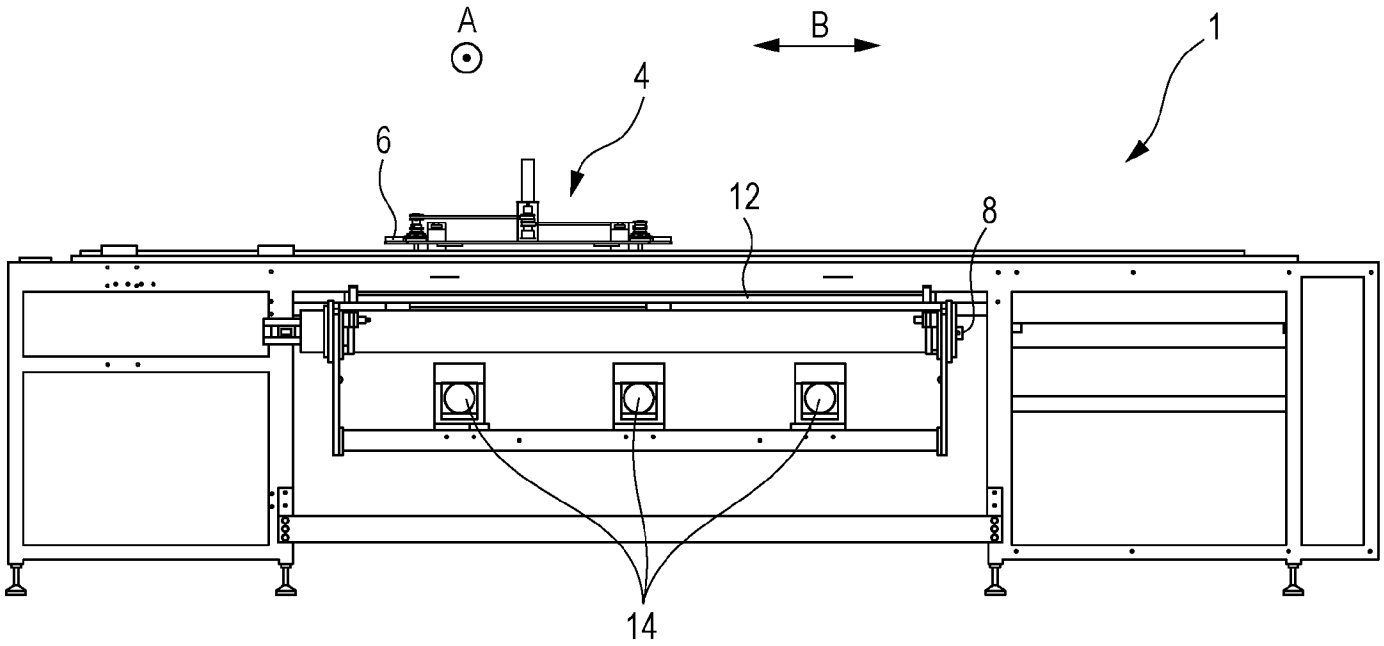

[Fig. 4]
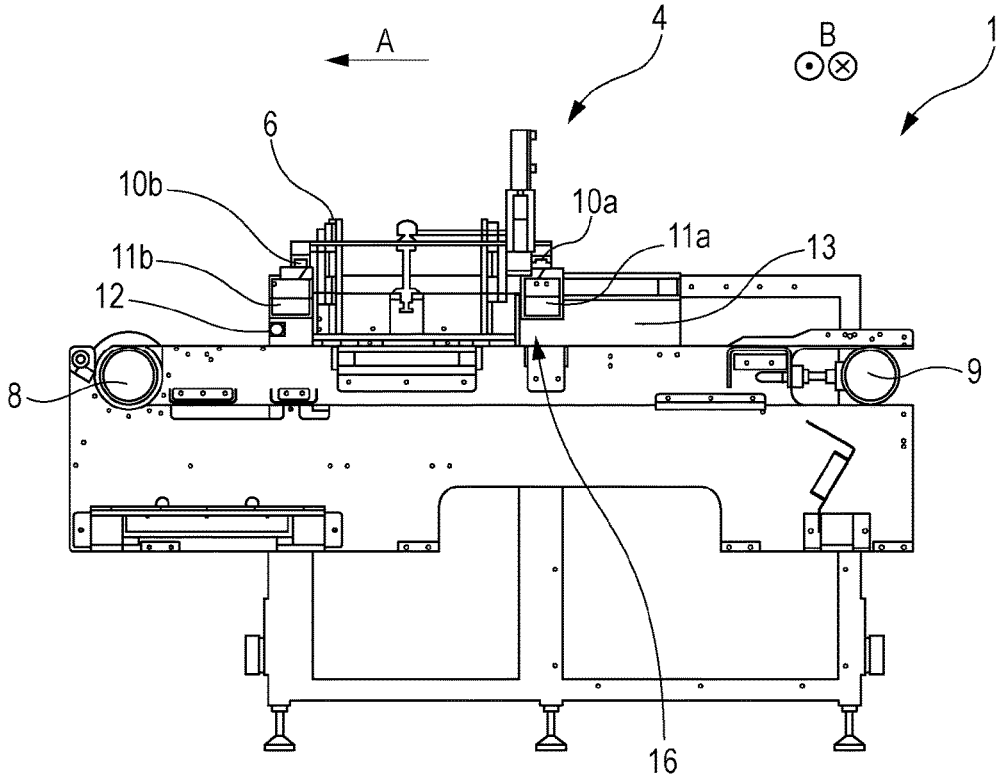

[Fig. 5]
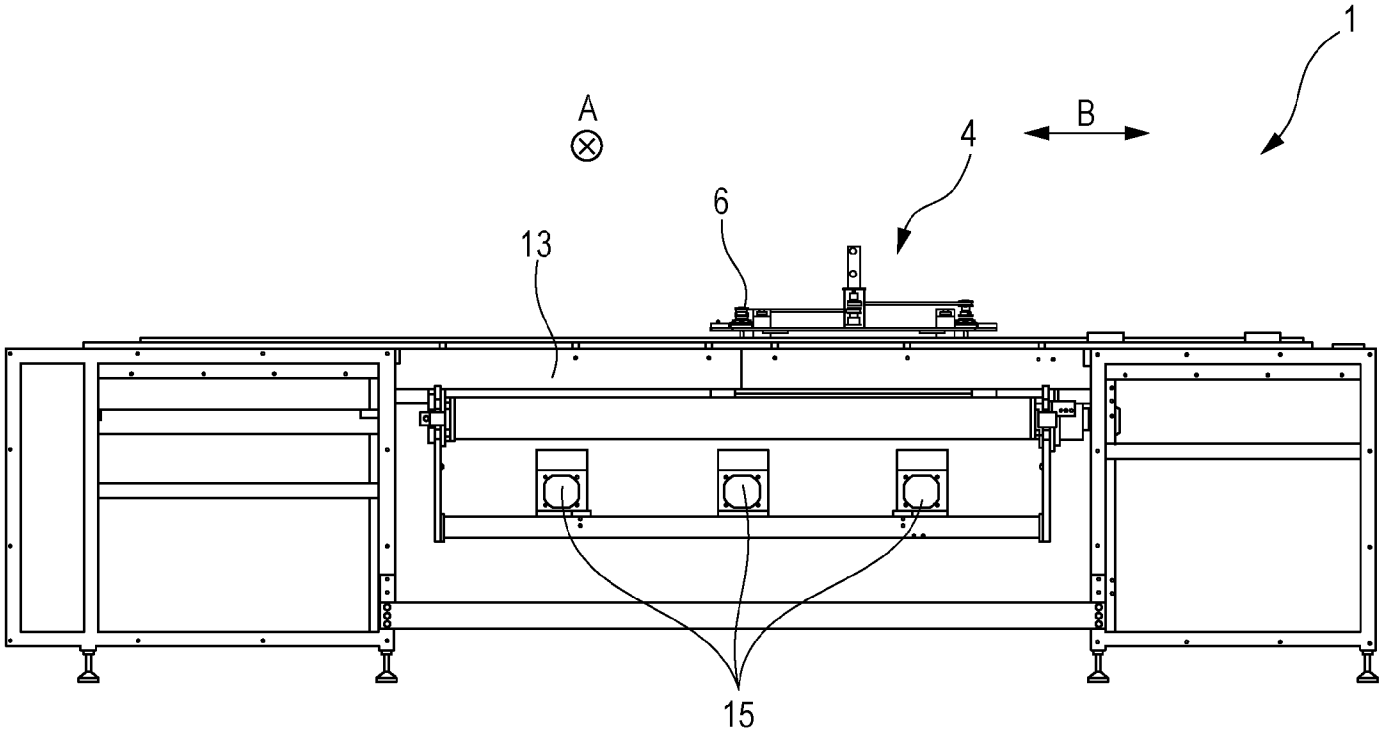

[Fig. 6]
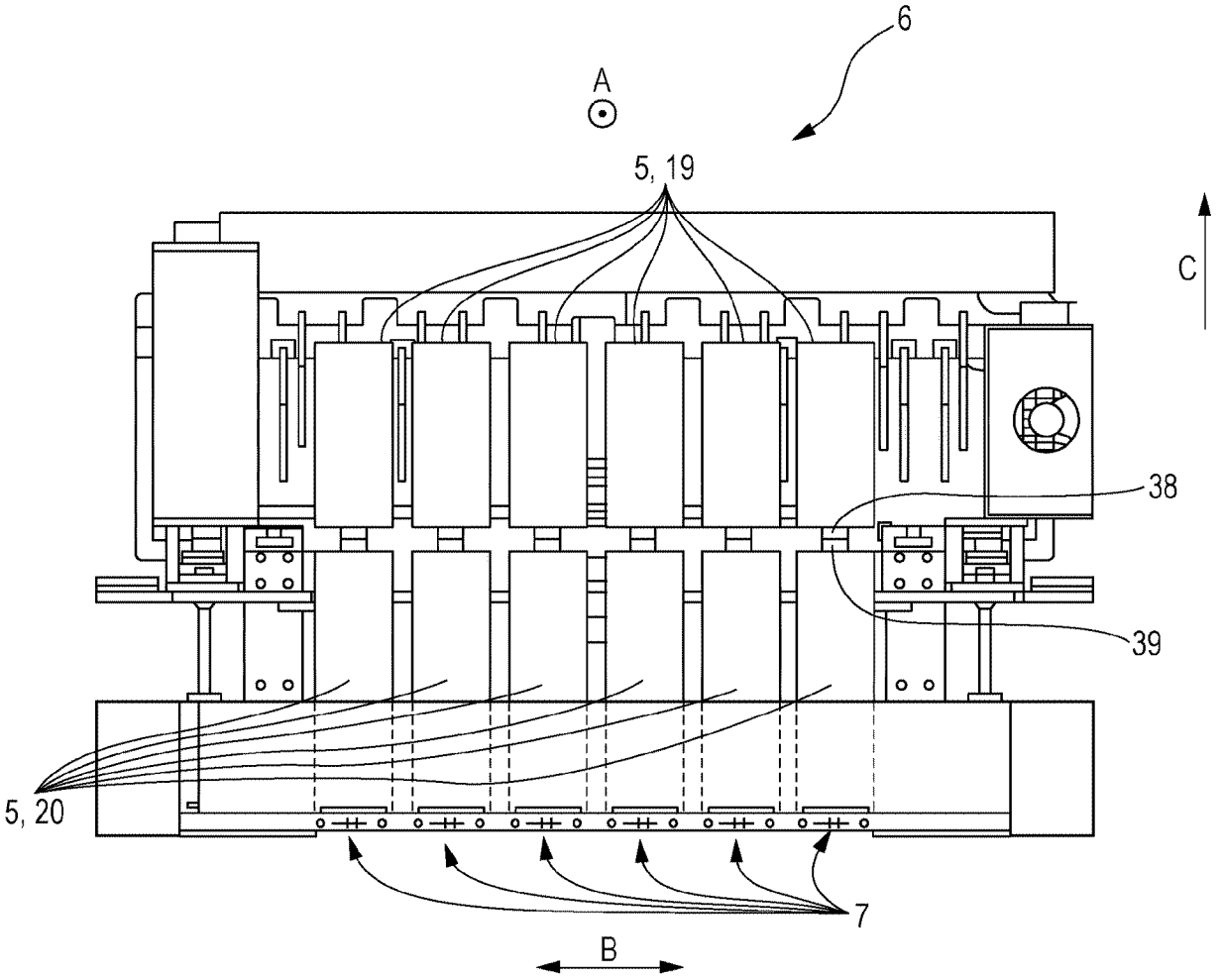

[Fig. 7]
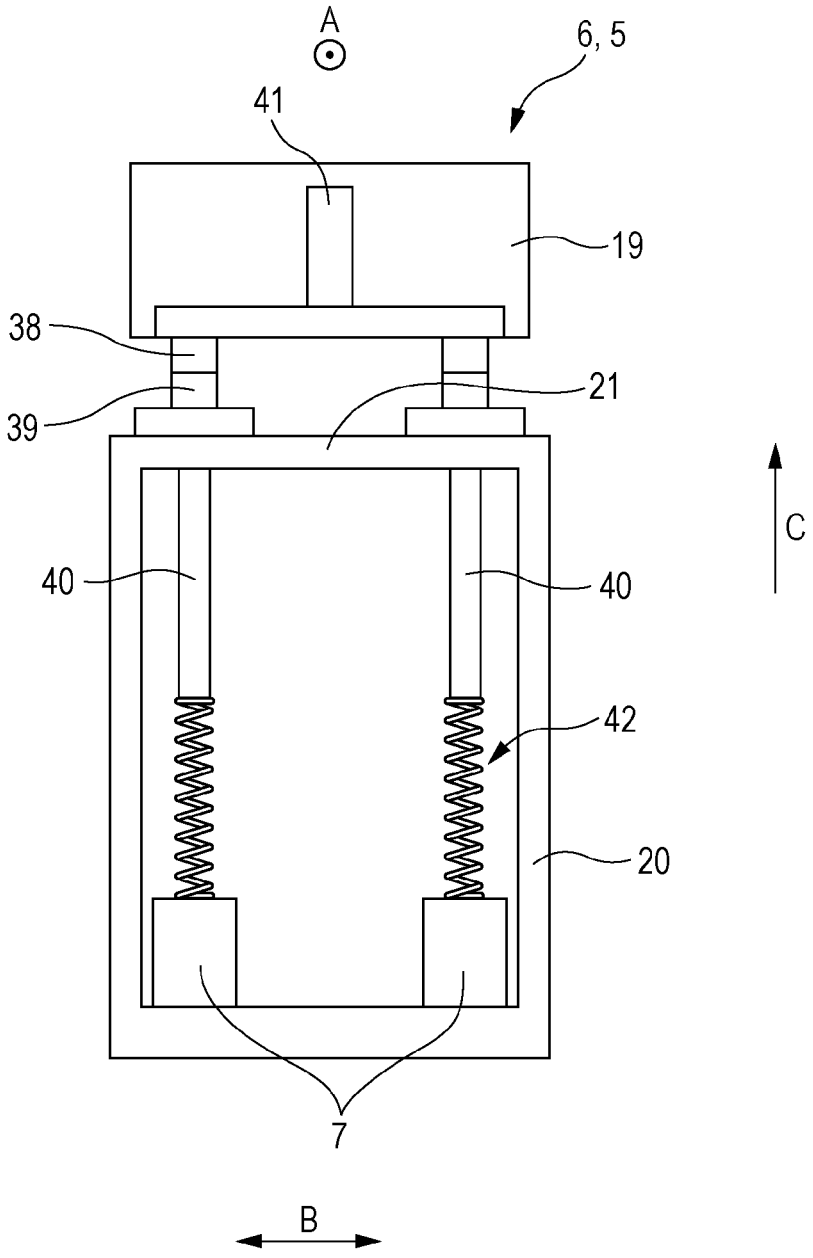

[Fig. 8]
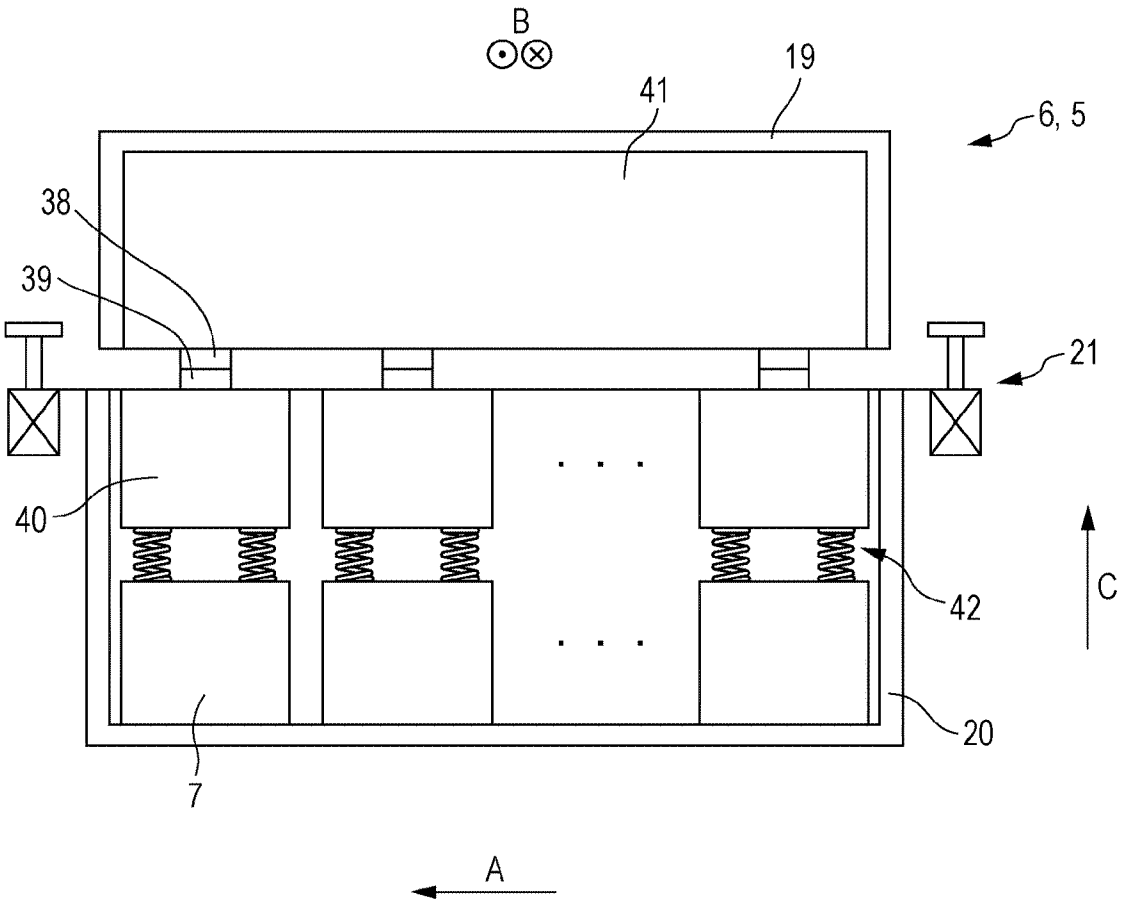

[Fig. 9]
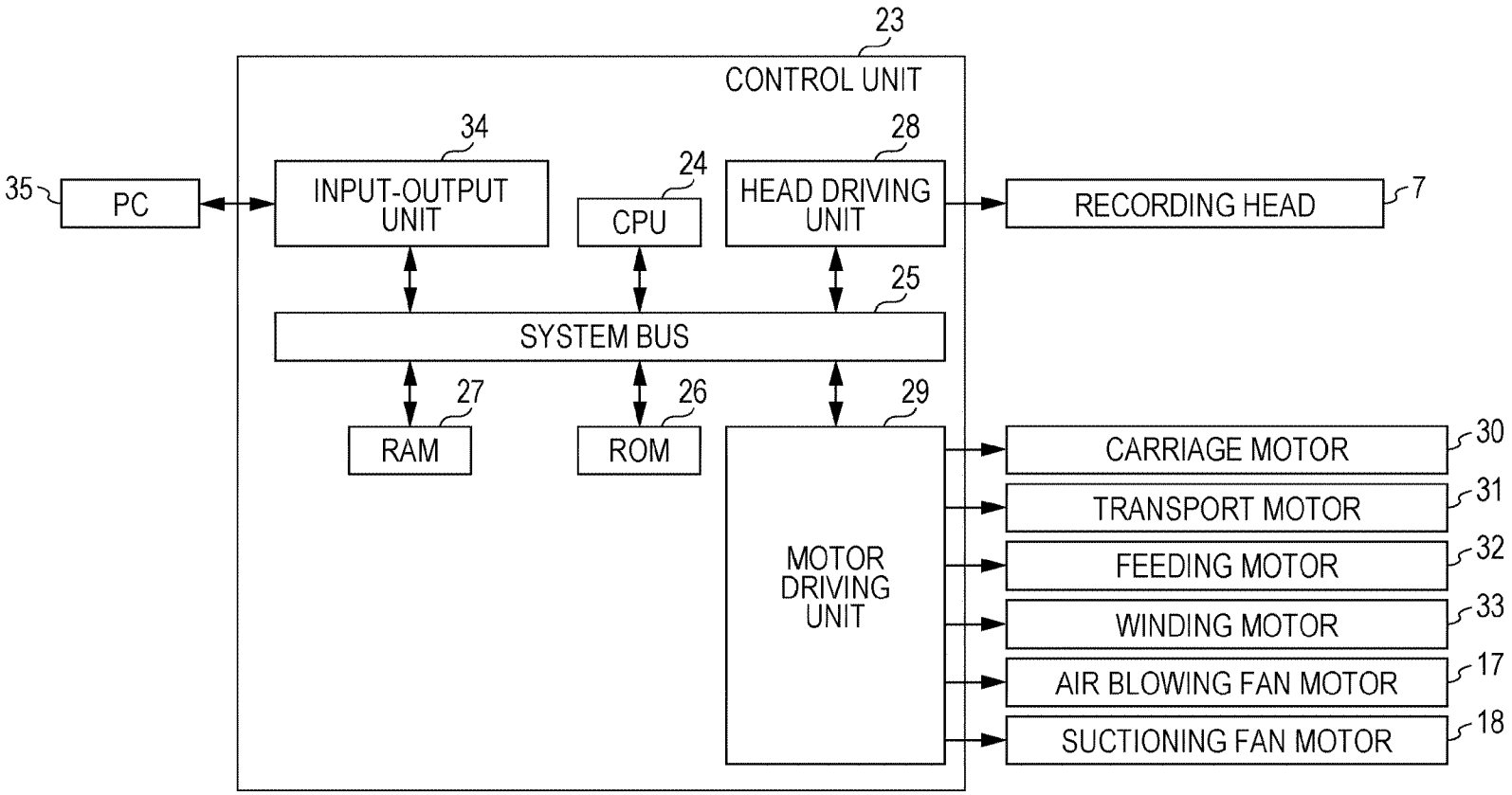

[Fig. 10]
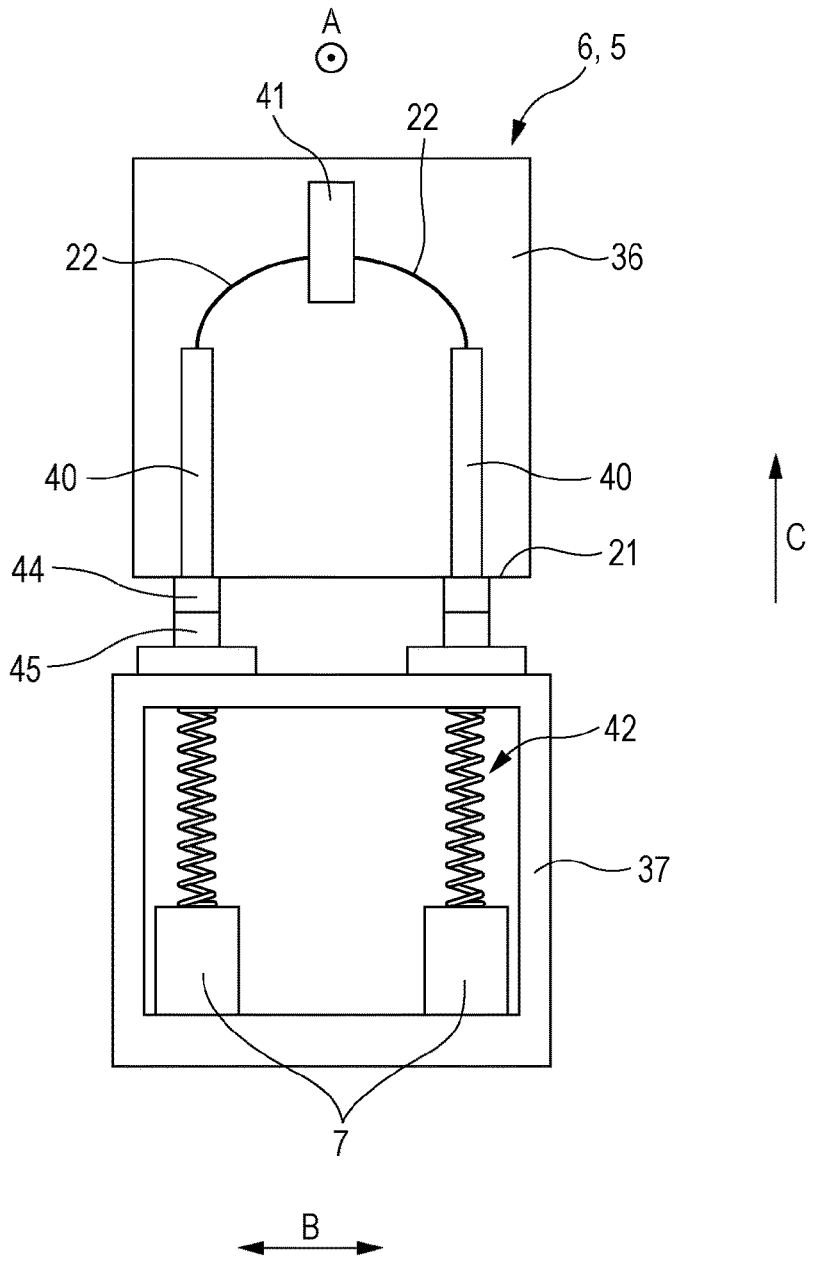

[Fig. 11]
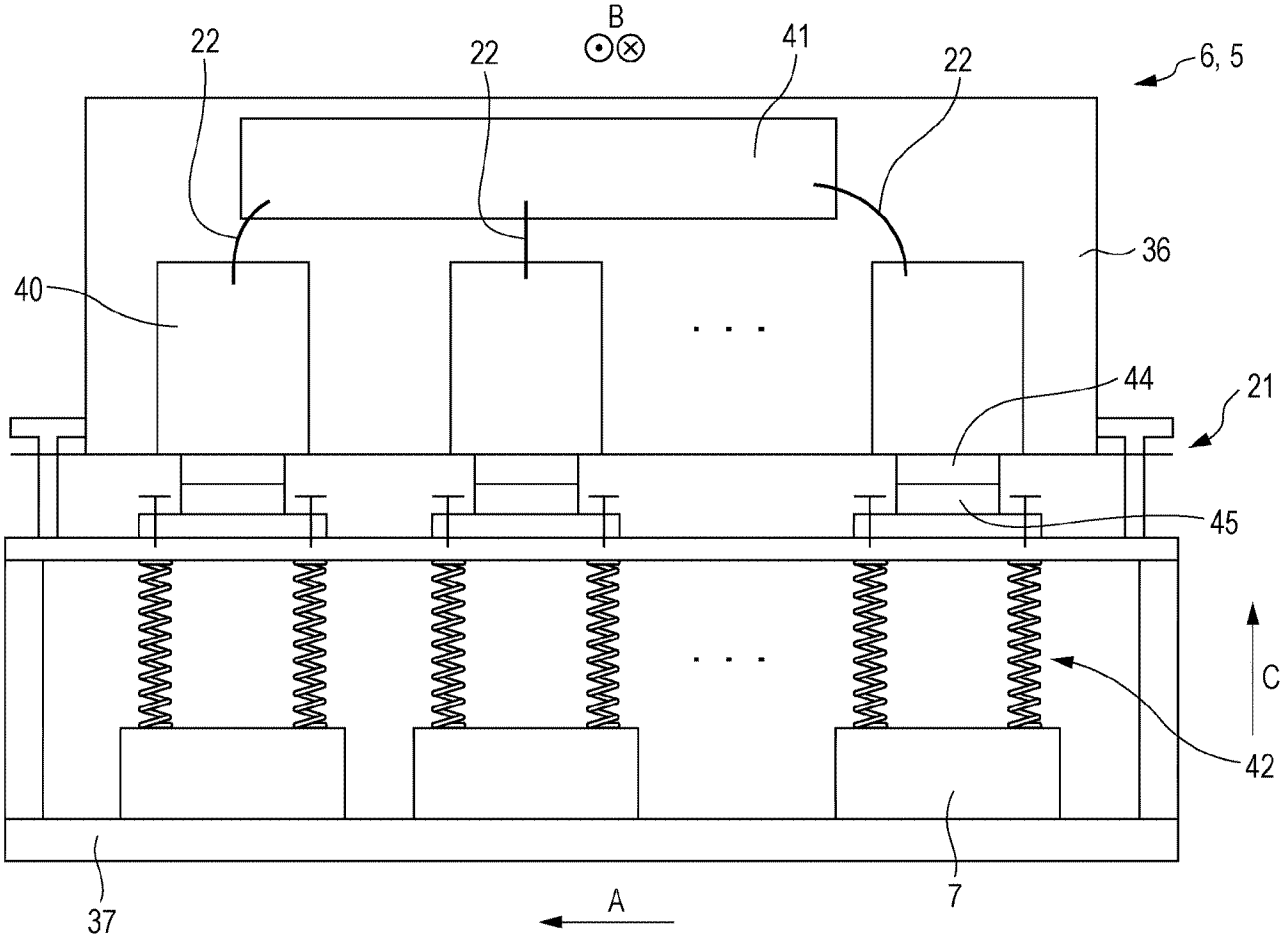

[Fig. 12]
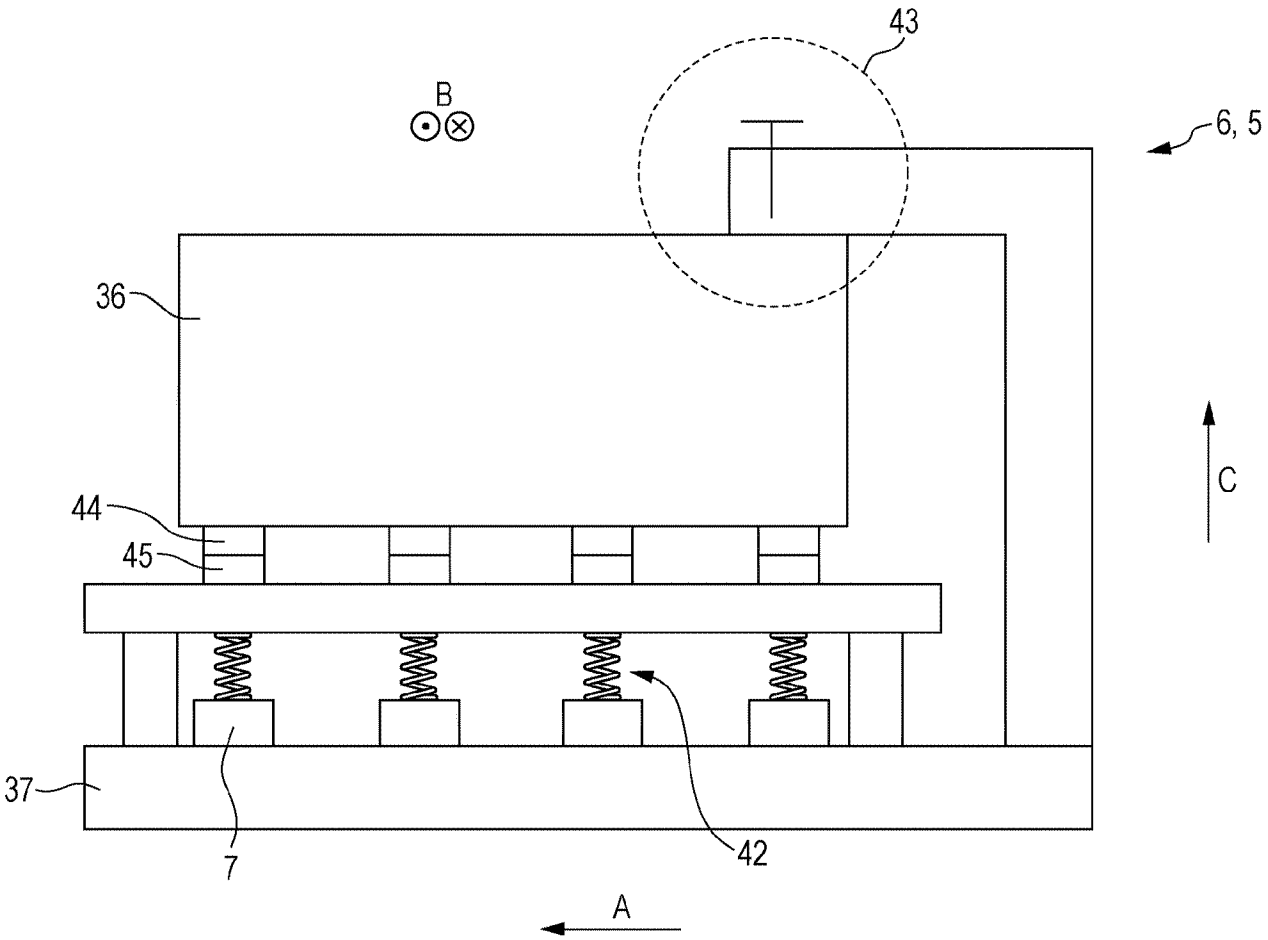

[Fig. 13]
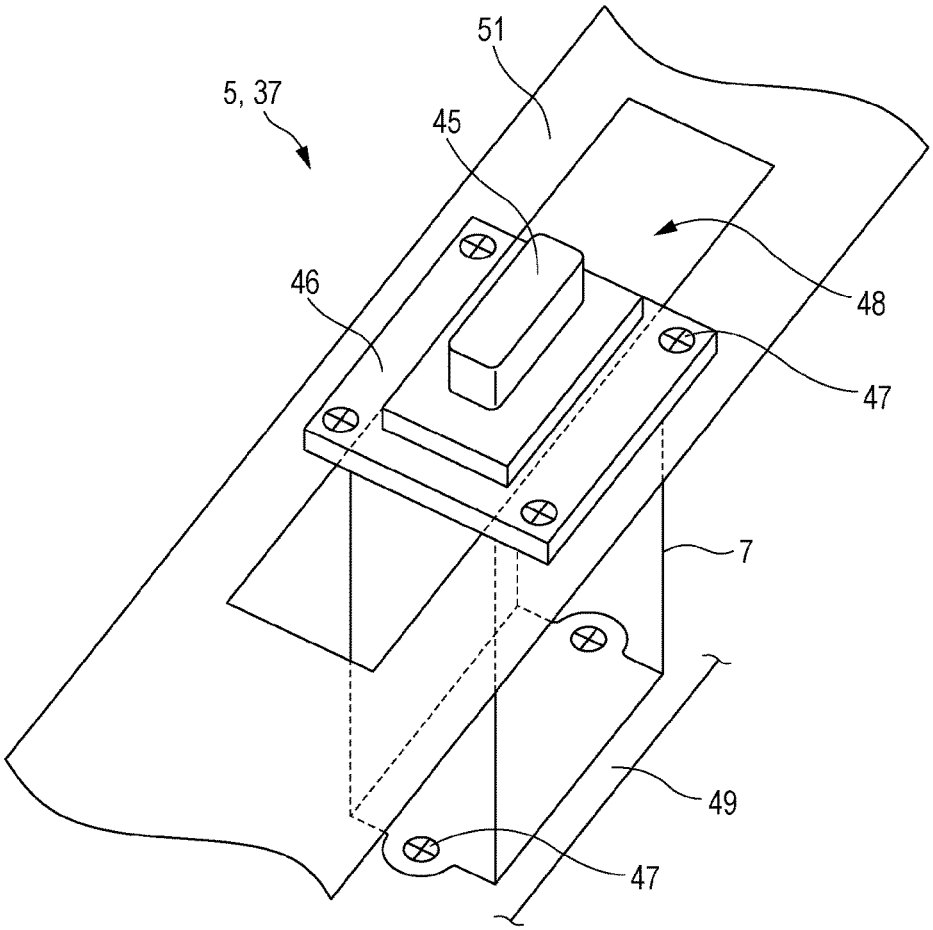

[Fig. 14]
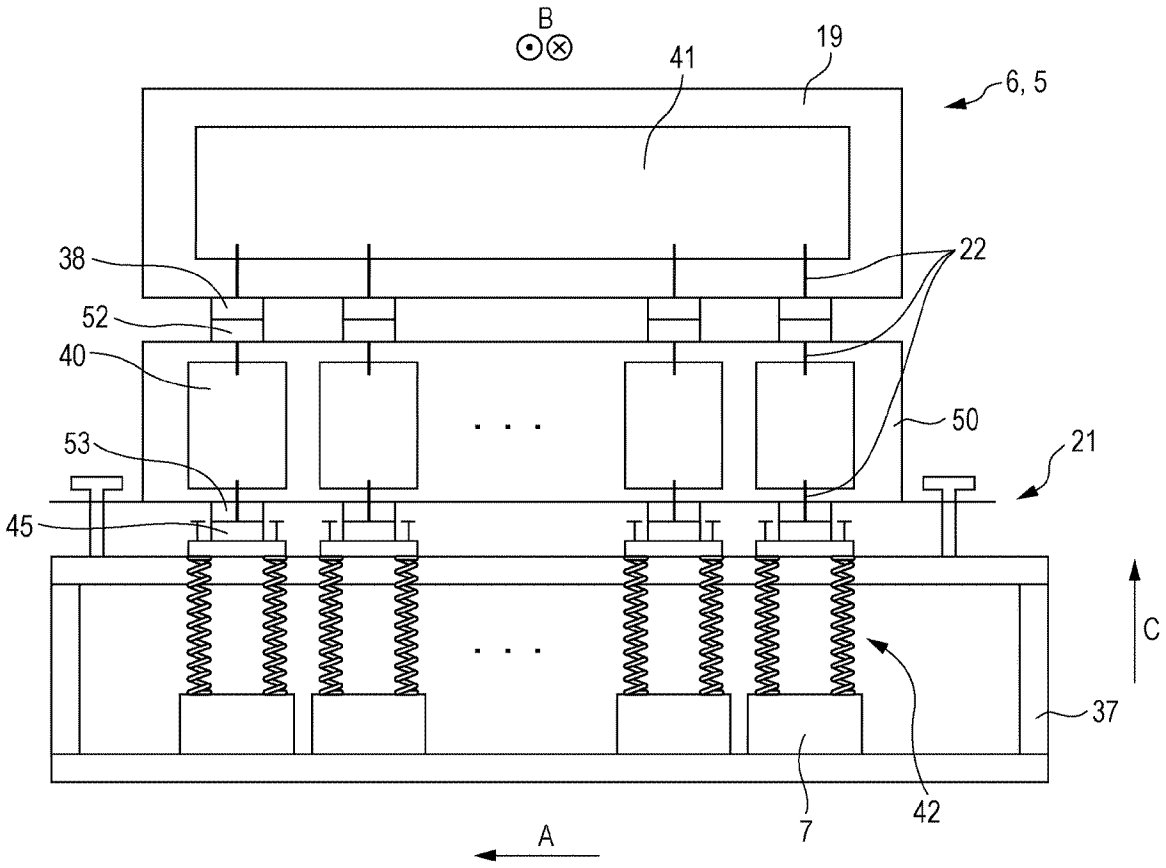

[Fig. 15]
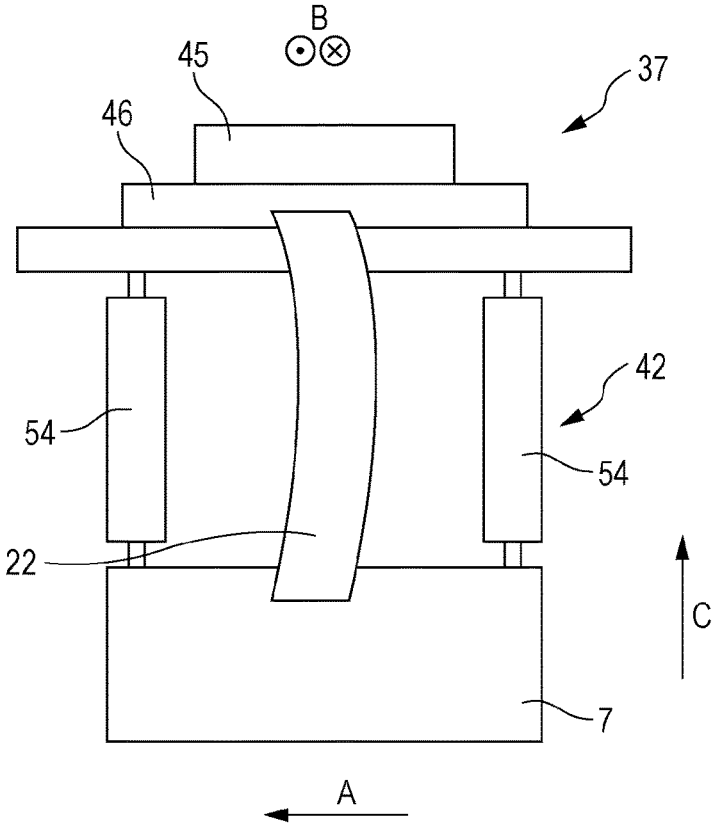

[Fig. 16]
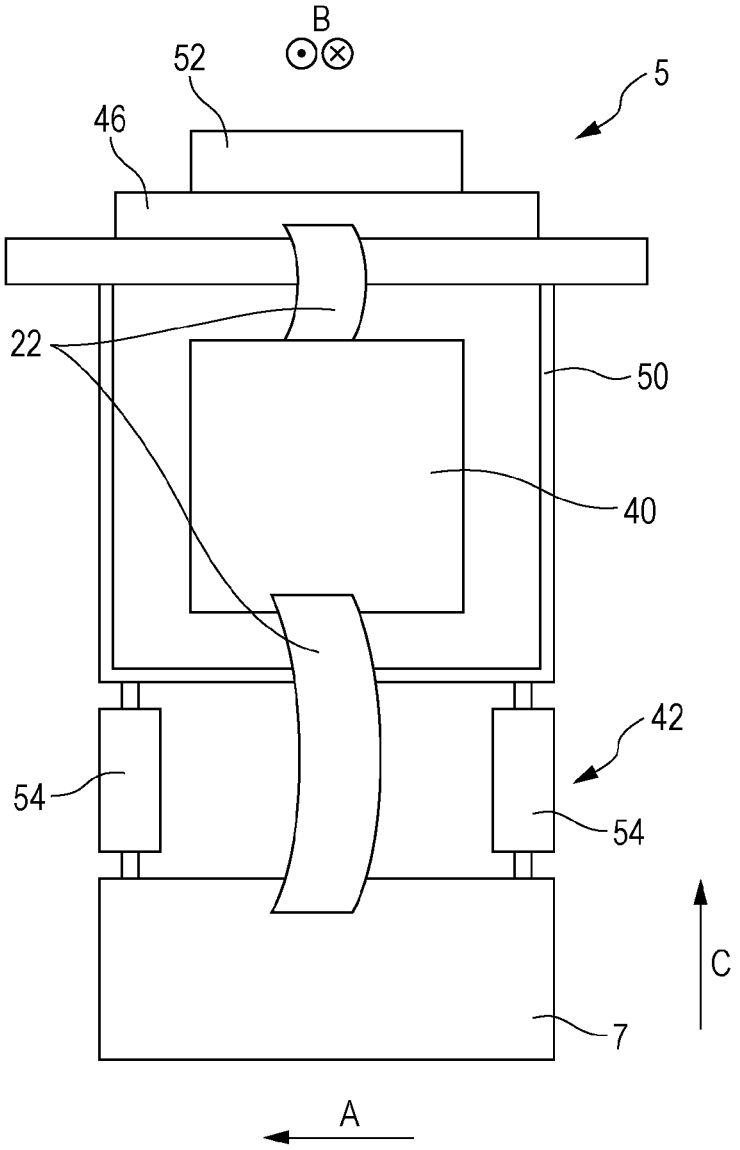

[Fig. 17]
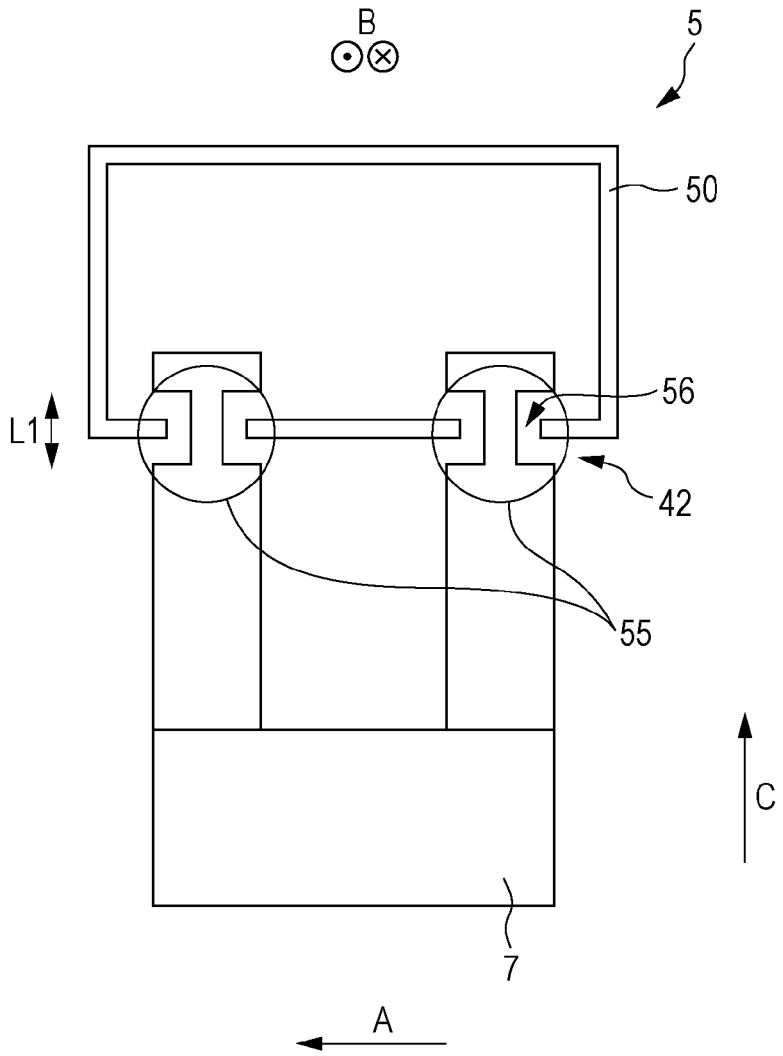

LIQUID EJECTING APPARATUS

CROSS-REFERENCE TO RELATED APPLICATIONS

This is a U.S. national phase application of PCT/JP2016/004747, filed on Oct. 28, 2016, which claims priority to Japanese Patent Application No. 2015-213579, filed on Oct. 30, 2015. The entire disclosure of Japanese Patent Application No. 2015-213579 is hereby incorporated herein by reference.

TECHNICAL FIELD

The present invention relates to a liquid ejecting apparatus.

BACKGROUND ART

In the related art, a liquid ejecting apparatus such as a recording apparatus which ejects liquid such as ink onto a medium, and perform recording has been disclosed. In such a liquid ejecting apparatus, an ejecting unit of liquid, or a driving substrate for driving the ejecting unit is provided.

For example, in JP-A-2014-94454 and JP-A-2006-205689, a liquid ejecting apparatus which is provided with an ejecting unit of liquid, and a driving substrate for driving the ejecting unit is disclosed.

SUMMARY

A driving substrate generates heat when being driven. Meanwhile, when a temperature of an ejecting unit rises, there is a case in which an adverse effect such as clogging of nozzles which eject liquid, or the like, easily occurs. In addition, since a driving substrate is provided in the vicinity of the ejecting unit in general, it is desirable to set so that heat generated due to driving of the driving substrate is not transferred to the ejecting unit. Here, in configurations of JP-A-2014-94454 and JP-A-2006-205689, a disposal in which heat from the driving substrate is easily transferred to the ejecting unit is performed; however, it easily becomes a configuration in which a load is applied to the ejecting unit from the driving substrate side, when a disposal in which heat from the driving substrate is rarely transferred to the ejecting unit, for example, a disposal in which the driving substrate is disposed by being erected with respect to the ejecting unit, or the like, is performed.

Therefore, an object of the invention is to prevent a load from being applied to an ejecting unit from a driving substrate.

A liquid ejecting apparatus according to a first aspect of the invention for solving the above described problem is a liquid ejecting apparatus which ejects liquid onto a medium, the liquid ejecting apparatus including a carriage which includes a control substrate configuring at least a part of a control unit which controls driving of the entire liquid ejecting apparatus, an ejecting unit which ejects the liquid, and a driving substrate which is connected to the control substrate and the ejecting unit, and drives the ejecting unit, in which the carriage is provided with a load absorbing unit which absorbs a physical load with respect to the ejecting unit from the driving substrate side.

According to the aspect, the carriage is provided with the load absorbing unit which absorbs the physical load with respect to the ejecting unit from the driving substrate side. For this reason, it is possible to reduce a force with which the ejecting unit is pushed to the driving substrate, and a force with which the ejecting unit is pulled toward the driving substrate, and prevent a load from being applied to the ejecting unit from the driving substrate side.

In the liquid ejecting apparatus according to a second aspect of the invention, in the first aspect, the carriage may include an ejecting unit-driving substrate accommodating unit which accommodates the ejecting unit and the driving substrate, and a control substrate accommodating unit which accommodates the control substrate.

According to the aspect, the carriage includes the ejecting unit-driving substrate accommodating unit which accommodates the ejecting unit and the driving substrate, and the control substrate accommodating unit which accommodates the control substrate. For this reason, it is possible to prevent a load from being applied to the ejecting unit from the driving substrate side, in a carriage with a configuration of including the ejecting unit-driving substrate accommodating unit, and the control substrate accommodating unit.

In the liquid ejecting apparatus according to a third aspect of the invention, in the first aspect, the carriage may include an ejecting unit accommodating unit which accommodates the ejecting unit, and a driving substrate-control substrate accommodating unit which accommodates the driving substrate and the control substrate.

According to the aspect, the carriage includes the ejecting unit accommodating unit which accommodates the ejecting unit, and the driving substrate-control substrate accommodating unit which accommodates the driving substrate and the control substrate. For this reason, it is possible to prevent a load from being applied to the ejecting unit from the driving substrate side, in the carriage with a configuration of including the ejecting unit accommodating unit and the driving substrate-control substrate accommodating unit.

In the liquid ejecting apparatus according to a fourth aspect of the invention, in the first aspect, the carriage may include the ejecting unit accommodating unit which accommodates the ejecting unit, a driving substrate accommodating unit which accommodates the driving substrate, and a control substrate accommodating unit which accommodates the control substrate.

According to the aspect, the carriage includes the ejecting unit accommodating unit which accommodates the ejecting unit, the driving substrate accommodating unit which accommodates the driving substrate, and the control substrate accommodating unit which accommodates the control substrate. For this reason, it is possible to prevent a load from being applied to the ejecting unit from the driving substrate side, in the carriage with a configuration of including the ejecting unit accommodating unit, the driving substrate accommodating unit, and the control substrate accommodating unit.

In the liquid ejecting apparatus according to a fifth aspect of the invention, in any one of the first to fourth aspects, the load absorbing unit may include an elastic body.

According to the aspect, the load absorbing unit includes the elastic body. For this reason, it is possible to effectively suppress an application of a load to the ejecting unit from the driving substrate side, particularly, by using the elastic body with an appropriate elastic force according to a configuration of the carriage, or the like.

In the liquid ejecting apparatus according to a sixth aspect of the invention, in any one of the first to fourth aspects, the load absorbing unit may include a movement regulating unit which is provided with play which permits an approach or a separation of the driving substrate with respect to the ejecting unit by a predetermined distance.

According to the aspect, the load absorbing unit includes the movement regulation unit provided with play which permits an approach or a separation of the driving substrate with respect to the ejecting unit by a predetermined distance. For this reason, it is possible to form the load absorbing unit in a simple configuration.

BRIEF DESCRIPTION OF DRAWINGS

FIG. 1 is a schematic perspective view which illustrates a recording apparatus according to a first embodiment of the invention.

FIG. 2 is a schematic plan view which illustrates the recording apparatus according to the first embodiment of the invention.

FIG. 3 is a schematic front view which illustrates the recording apparatus according to the first embodiment of the invention.

FIG. 4 is a schematic side view which illustrates the recording apparatus according to the first embodiment of the invention.

FIG. 5 is a schematic rear view which illustrates the recording apparatus according to the first embodiment of the invention.

FIG. 6 is a schematic front view which illustrates main portions of the recording apparatus according to the first embodiment of the invention.

FIG. 7 is a front perspective view which schematically illustrates the main portions of the recording apparatus according to the first embodiment of the invention.

FIG. 8 is a side perspective view which schematically illustrates the main portions of the recording apparatus according to the first embodiment of the invention.

FIG. 9 is a block diagram which illustrates the recording apparatus according to the first embodiment of the invention.

FIG. 10 is a front perspective view which schematically illustrates main portions of a recording apparatus according to a second embodiment of the invention.

FIG. 11 is a side perspective view which schematically illustrates the main portions of the recording apparatus according to the second embodiment of the invention.

FIG. 12 is a side perspective view which schematically illustrates main portions which can be adopted in the recording apparatus according to the second embodiment of the invention.

FIG. 13 is a schematic perspective view which illustrates the main portions of the recording apparatus according to the second embodiment of the invention.

FIG. 14 is a side perspective view which schematically illustrates main portions of a recording apparatus according to a third embodiment of the invention.

FIG. 15 is a side perspective view which schematically illustrates the main portions of the recording apparatus according to the third embodiment of the invention.

FIG. 16 is a side perspective view which schematically illustrates main portions of a recording apparatus according to a fourth embodiment of the invention.

FIG. 17 is a side perspective view which schematically illustrates main portions of a recording apparatus according to a fifth embodiment of the invention.

DESCRIPTION OF EMBODIMENTS

Hereinafter, a recording apparatus according to an embodiment of the invention, as a liquid ejecting apparatus, will be described with reference to accompanying drawings.

First Embodiment (FIGS. 1 to 9)

First, an outline of a recording apparatus 1 according to a first embodiment of the invention will be described.

FIG. 1 is a schematic perspective view of the recording apparatus 1 in the embodiment. FIG. 2 is a schematic plan view which illustrates the recording apparatus 1 according to the embodiment. FIG. 3 is a schematic front view of the recording apparatus 1 according to the embodiment. FIG. 4 is a schematic side view of the recording apparatus 1 according to the embodiment. In addition, FIG. 5 is a schematic rear view of the recording apparatus 1 according to the embodiment. In addition, FIGS. 1 to 5 illustrate a state in which a part of constituent members is detached from the recording apparatus 1 of the embodiment, and for example, a state in which a sub-carriage 5 (refer to FIG. 6) is detached from the carriage 6.

The recording apparatus 1 according to the embodiment is provided with a transport mechanism 3 which transports a medium for recording in a transport direction A using an adhesive belt 2 (endless belt) which supports the medium for recording (medium) on a supporting face to which an adhesive is attached. In addition, a feeding unit (not illustrated) in which a roll-shaped medium for recording can be set, and it is possible to send out the medium for recording to the transport mechanism 3 is provided. In addition, a recording mechanism 4 which performs recording by causing a carriage 6 including a recording head 7 as the ejecting unit to perform reciprocating scanning in a reciprocating direction B which intersects the transport direction A of the medium for recording is provide in a transport region of the medium for recording using the transport mechanism 3. A winding mechanism (not illustrated) which can wind up the medium for recording, on which recording is performed in the recording mechanism 4, is further provided.

The transport mechanism 3 in the embodiment is provided with the adhesive belt 2 which transports the medium for recording sent out from the feeding unit, by mounting thereof, a driving roller 8 which moves the adhesive belt 2, and a driven roller 9. The medium for recording is mounted on a support face of the adhesive belt 2 by being attached thereto.

However, the endless belt as the transport belt is not limited to the adhesive belt. For example, an electrostatic attraction-type endless belt may be used.

In addition, the recording apparatus 1 according to the embodiment is provided with the transport mechanism 3 with such a configuration; however, it is not limited to the transport mechanism with such a configuration, and it may be a configuration in which the medium for recording is transported by being supported by a mobile support tray, or the like, a configuration in which the medium for recording is transported using a pair of rollers, or the like. In addition, the recording apparatus may be a so-called flat bed-type recording apparatus in which recording is performed by fixing the medium for recording to the support unit, and moving the recording head 7 with respect to the fixed medium for recording.

The recording mechanism 4 includes a carriage motor 30 (refer to FIG. 9) which causes the carriage 6 provided with the recording head 7 which can eject ink (liquid) to reciprocate in the reciprocating direction B.

The recording apparatus 1 according to the embodiment performs recording by causing the carriage 6 including the recording head 7 to perform reciprocating scanning, when performing recording; however, the transport mechanism 3 stops transporting of the medium for recording in the middle of recording scanning (in the middle of moving of carriage 6). In other words, reciprocating scanning of the carriage 6, and transporting of the medium for recording are alternately performed, when performing recording. That is, when performing recording, the transport mechanism 3 is intermittently transported (intermittent moving of adhesive belt 2) corresponding to reciprocating scanning of the carriage 6.

The recording apparatus 1 according to the embodiment includes the recording head 7 which performs recording while reciprocating; however, the recording apparatus may be a recording apparatus which includes a so-called line head in which a plurality of nozzles which eject ink are provided in an intersecting direction which intersects the transport direction A.

Here, the "line head" is a recording head in which a region of nozzles which are formed in the intersecting direction which intersects the transport direction A of the medium for recording is provided so as to cover the entire intersecting direction of the medium for recording, and which is used in a recording apparatus which form an image by relatively moving a recording head or a medium for recording. In addition, a region of the nozzles in the intersecting direction of the line head may not cover the entire intersecting direction of all of mediums for recording to which the recording apparatus corresponds.

In addition, the "carriage" in the invention means a carriage which includes an ejecting unit, and is used by having a configuration in which a medium and an ejecting unit can be relatively moved. For this reason, the line head (or accommodating unit which accommodates line head) is also included in the carriage in the invention.

A rail 10*a* which extends in the reciprocating direction B is formed in a pipe 11*a* which configures a skeleton portion of the recording apparatus 1 of the embodiment, and a rail 10*b* which extends in the reciprocating direction B is formed in a pipe 11*b* which configures the skeleton portion of the recording apparatus 1 of the embodiment. In addition, a movement in the reciprocating direction B of the carriage 6 in the embodiment is guided by the rail 10*a* and rail 10*b*, when a bearing (not illustrated) is received in the rail 10*a* and rail 10*b*.

An air blowing unit 12 which extends in the reciprocating direction B, and sends air in a direction opposite to the transport direction A from a plurality of blasting ports (not illustrated) is further provided at a position in the lower part of the pipe 11*b*. In addition, a mist collecting unit 13 which extends in the reciprocating direction B, and can collect mist of ink ejected from the recording head 7 is provided in the lower part of the pipe 11*a*. A collecting port 16 which extends in the reciprocating direction B is provided in the lower part of the pipe 11*a*, in the mist collecting unit 13.

In addition, as illustrated in FIG. 3, a plurality of (three) air blowing fans 14 which generate a blasting force using the air blowing unit 12 are provided on the downstream side in the transport direction A of the recording apparatus 1 of the embodiment. Due to the blasting force which is generated by the air blowing fan 14, the air blowing unit 12 can send air toward the collecting port 16 from the outside (position on downstream side in transport direction A) of the collecting unit 13. In addition, as illustrated in FIG. 5, a plurality of (three) suctioning fans 15 as a suctioning unit which generate an air current from the collecting port 16 toward the inside of the collecting unit 13, and from the inside of the collecting unit 13 toward the outside of the recording apparatus 1 are provided on the upstream side in the transport direction A of the recording apparatus 1 in the embodiment.

Subsequently, the carriage 6, and a sub-carriage 5 mounted on the carriage 6 which are main portions of the recording apparatus 1 of the embodiment will be described.

Here, FIG. 6 is a schematic front view of the carriage 6. FIG. 7 is a front perspective view which schematically illustrates the sub-carriage 5. In addition, FIG. 8 is a side perspective view which schematically illustrates the sub-carriage 5.

As illustrated in FIG. 6, the carriage 6 in the embodiment is configured so that it is possible to perform reciprocating scanning in the reciprocating direction B by mounting the plurality of sub-carriages 5.

As illustrated in FIGS. 7 and 8, the sub-carriage 5 includes a control substrate accommodating unit 19 which accommodates a control substrate 41 configuring a part of a control unit 23 (refer to FIG. 9) which controls driving of the entire recording apparatus 1, and an ejecting unit-driving substrate accommodating unit 20 which accommodates the recording head 7, and a driving substrate 40 which drives the recording head 7. In addition, the control substrate accommodating unit 19 and the ejecting unit-driving substrate accommodating unit 20 are connected using a connecting portion 38 (connector terminal) on the control substrate accommodating unit 19 side, and a connecting portion 39 (connector terminal) on the ejecting unit-driving substrate accommodating unit 20 side. In addition, the driving substrate 40 and the recording head 7 are connected through a load absorbing unit 42.

As illustrated in FIGS. 7 and 8, a fixing portion 21 which fixes the driving substrate 40 which is connected to the carriage 6 is provided above the driving substrate 40 in the ejecting unit-driving substrate accommodating unit 20 between the control substrate accommodating unit 19 and the ejecting unit-driving substrate accommodating unit 20. In other words, the fixing portion 21 which fixes a position of the driving substrate 40 with respect to the recording head 7 is provided on the upper side (side opposite to recording head 7) of the driving substrate 40, in the carriage 6 (sub-carriage 5).

In addition, as illustrated in FIGS. 7 and 8, the driving substrate 40 according to the embodiment is provided along a direction of the recording head 7 (direction which goes along vertically upper direction C) with respect to the driving substrate 40. In other words, the driving substrate 40 according to the embodiment is disposed so as not to face the recording head 7. For this reason, it is possible to efficiently prevent heat generated by the driving substrate 40 from being transmitted to the recording head 7.

Subsequently, an electrical configuration in the recording apparatus 1 in the embodiment will be described.

FIG. 9 is a block diagram of the recording apparatus 1 according to the embodiment.

A CPU 24 which controls the entire recording apparatus 1 is provided in the control unit 23 which controls driving of the entire recording apparatus 1 in the embodiment. The CPU 24 is connected to a ROM 26 which stores various control programs which are executed by the CPU 24, and a RAM 27 which can temporarily store data through the system bus 25.

In addition, the CPU 24 is connected a head driving unit 28 for driving the recording head 7 through a system bus 25.

In addition, the CPU 24 is connected to a motor driving unit 29 which drives a carriage motor 30, a transport motor 31, a feeding motor 32, a winding motor 33, an air blowing fan motor 17, and a suctioning fan motor 18 through the system bus 25.

The carriage motor 30 is a motor for moving the carriage 6 including the recording head 7. In addition, the transport motor 31 is a motor for driving the driving roller 8. In addition, the feeding motor 32 is a driving motor of the feeding unit which sends out a medium for recording which is set in the feeding unit (not illustrated) to the transport mechanism 3. The winding motor 33 is a driving motor for driving a winding mechanism (not illustrated) in order to wind a medium for recording on which recording is performed. The air blowing fan motor 17 is a motor for driving the air blowing fan 14. In addition, the suctioning fan motor 18 is a motor for driving the suctioning fan 15.

In addition, the CPU 24 is connected to an input-output unit 34 through the system bus 25, and the input-output unit 34 is connected to a PC 35 for performing transceiving of data such as recording data, and signals.

As described above, the recording apparatus 1 in the embodiment is a recording apparatus which ejects ink onto a medium for recording, and is provided with the carriage 6 including the control substrate 41 which configures at least a part of the control unit 23 which controls driving of the entire recording apparatus 1, the recording head 7 which ejects ink, and the driving substrate 40 which is connected to the control substrate 41 and the recording head 7, and drives the recording head 7.

In addition, the carriage 6 is provided with the fixing portion 21 which fixes a position of the driving substrate 40 with respect to a position of the recording head 7. For this reason, a movement of the driving substrate 40 in a direction of approaching, and a direction of separating from the recording head 7, that is, pressing or pulling of the recording head 7 with respect to the driving substrate 40 is suppressed, and a load which is applied to the recording head 7 from the driving substrate 40 side is suppressed.

In addition, as described above, the carriage 6 is provided with the load absorbing unit 42 which absorbs a physical load with respect to the recording head 7 from the driving substrate 40. For this reason, even when the driving substrate 40 moves in the direction of approaching, and the direction of separating from the recording head 7, a pushing force and a pulling force of the driving substrate 40 with respect to the recording head 7 is reduced, and a load which is applied to the recording head 7 from the driving substrate 40 side is suppressed.

As described above, the carriage 6 in the embodiment is provided with the ejecting unit-driving substrate accommodating unit 20 which accommodates the recording head 7 and the driving substrate 40, and the control substrate accommodating unit 19 which accommodates the control substrate 41. For this reason, in the recording apparatus 1 according to the embodiment, it is possible to express that an application of a load to the recording head 7 from the driving substrate 40 side is suppressed, in the carriage 6 which is provided with the ejecting unit-driving substrate accommodating unit 20 and the control substrate accommodating unit 19.

As illustrated in FIGS. 7 and 8, the fixing portion 21 in the embodiment fixes the position of the driving substrate 40 with respect to the position of the recording head 7 from above. In this manner, the recording apparatus 1 in the embodiment can effectively suppress falling (position shift) of the vertically long accommodating unit (ejecting unit-driving substrate accommodating unit 20) which accommodates the driving substrate 40, particularly, by being fixed from above (vertically upward direction C) using the fixing portion 21.

In addition, the fixing portion 21 in the embodiment fixes the position of the driving substrate 40 with respect to the position of the recording head 7 in the vertically upward direction C; however, it may be a configuration of fixing the position from the upper side, and a direction slightly shifted from the vertically upward direction, not in the vertically upward direction C in a strict sense.

As illustrated in FIGS. 7 and 8, the recording apparatus 1 in the embodiment is provided with the plurality of recording heads 7, and the plurality of driving substrates 40 which are connected to the control substrate 41, and to the plurality of recording heads 7 in one-to-one correspondence, in the carriage 6. In addition, the plurality of driving substrates 40 are connected to the control substrate 41. With such a configuration, when exchanging the recording head 7, the recording apparatus 1 according to the embodiment can collectively detach the control substrate 41 from the plurality of driving substrates 40 (that is, detaching control substrate accommodating unit 19 from ejecting unit-driving substrate accommodating unit 20), detach a driving substrate 40 corresponding to a recording head 7 to be exchanged from the recording head 7 individually, after making a space, and switch the recording head 7. Accordingly, it is possible to improve workability when exchanging the recording head 7.

More specifically, the carriage 6 according to the embodiment is divided into a group in each one or a plurality of sub-carriages 5 which correspond to ink of different types. In addition, one control substrate 41 is collectively connected to the plurality of driving substrates 40 in each sub-carriage 5 (refer to FIGS. 6 to 8).

In other words, the plurality of recording heads 7 are configured so as to eject ink of a different type in each group, and the control substrate 41 is collectively connected to the driving substrate 40 in each group. In the configuration in which ink of a different type can be ejected, in general, since the recording head 7 is exchanged in each group, workability when exchanging the recording head 7 is improved. In addition, since it is a configuration in which it is possible to reduce the number of times of releasing a connection between the control substrate 41 and the driving substrate 40 (configuration in which it is not necessary to also detach driving substrate 40 in group which is not exchanged with respect to control substrate 41), it is possible to suppress a damage of the connecting portions 38 and 39 which is associated with releasing of the connection between the control substrate 41 and the driving substrate 40.

Meanwhile, the control substrate 41 may be collectively connected to all of the driving substrates 40. The reason for this is that it is possible to effectively improve workability when exchanging the recording head 7, particularly, when exchanging a lot of recording heads 7, for example, by adopting such a configuration.

In addition, in the recording apparatus 1 according to the embodiment, the ejecting unit-driving substrate accommodating unit 20 and the control substrate accommodating unit 19 are connected using the connecting portions 38 and 39 as the connector terminal. For this reason, it becomes a configuration in which workability when bonding the ejecting unit-driving substrate accommodating unit 20 and the control substrate accommodating unit 19, and detaching thereof is improved.

Second Embodiment (FIGS. 10 to 13)

Subsequently, a recording apparatus according to a second embodiment of the invention will be described.

FIG. 10 is a front perspective view which schematically illustrates a sub-carriage 5 in the embodiment, and corresponds to FIG. 7 which illustrates the sub-carriage 5 according to the first embodiment. FIG. 11 is a side perspective view which schematically illustrates the sub-carriage 5 in the embodiment, and corresponds to FIG. 8 which illustrates the sub-carriage 5 of the recording apparatus 1 according to the first embodiment. In addition, FIG. 12 is a side perspective view which schematically illustrates a carriage 6 which includes a fixing portion 43 which can be adopted in a carriage 6 in the embodiment. FIG. 13 is a schematic perspective view of a part of the sub-carriage 5 in the embodiment.

In addition, constituent elements which are common to those in the first embodiment are denoted by the same reference numerals, and detailed descriptions thereof are omitted.

The recording apparatus 1 in the embodiment is different from the recording apparatus 1 in the first embodiment only in a configuration of the carriage 6.

As described above, the carriage 6 (sub-carriage 5) according to the first embodiment includes the ejecting unit-driving substrate accommodating unit 20 which accommodates the recording head 7 and the driving substrate 40, and the control substrate accommodating unit 19 which accommodates the control substrate 41.

Meanwhile, as illustrated in FIGS. 10 and 11, the carriage 6 (sub-carriage 5) according to the embodiment is provided with an ejecting unit accommodating unit 37 which accommodates the recording head 7, and a driving substrate-control substrate accommodating unit 36 which accommodates the driving substrate 40 and the control substrate 41. In addition, similarly to the carriage 6 in the first embodiment, the fixing portion 21 and the load absorbing unit 42 are provided. For this reason, in the recording apparatus 1 according to the embodiment, it is possible to suppress an application of a load to the recording head 7 from the driving substrate 40 side, in the carriage 6 with a configuration of including the ejecting unit accommodating unit 37, and the driving substrate-control substrate accommodating unit 36.

As illustrated in FIGS. 10 and 11, the driving substrate 40 and the control substrate 41 in the embodiment are connected through a flexible flat cable (FFC) 22, in the inside of the driving substrate-control substrate accommodating unit 36. In addition, the driving substrate-control substrate accommodating unit 36 and the ejecting unit accommodating unit 37 are connected, using a connecting portion 44 (connector terminal) on the driving substrate-control substrate accommodating unit 36 side, and a connecting portion 45 (connecter terminal) on the ejecting unit accommodating unit 37 side.

In addition, as illustrated in FIG. 10, the fixing portion 21 in the embodiment has a configuration of fixing a position of the driving substrate 40 with respect to a position of the recording head 7, by screwing the driving substrate-control substrate accommodating unit 36 to the ejecting unit accommodating unit 37. Meanwhile, as illustrated in FIG. 12, a configuration may be adopted, in which a position of the driving substrate 40 with respect to a position of the recording head 7 is fixed, by fixing the driving substrate-control substrate accommodating unit 36 to a position which is a part of the carriage 6 other than the ejecting unit accommodating unit 37, using the fixing portion 43, instead of a configuration of using the fixing portion 21 in the embodiment.

In addition, as illustrated in FIG. 13, in the ejecting unit accommodating unit 37 according to the embodiment, a hole portion 48 is formed in the fixing portion 21. As illustrated in FIG. 13, it is a configuration in which the recording head 7 is fixed to the ejecting unit accommodating unit 37, by causing the recording head 7 to pass through the hole portion 48, and fixing a lower face side of the recording head 7 and a lower face side 49 of the ejecting unit accommodating unit 37, and a relay substrate 46 which is provided on a top face side of the recording head 7 and an upper face side 51 of the ejecting unit accommodating unit 37 using screws 47.

Third Embodiment (FIGS. 14 and 15)

Subsequently, a recording apparatus according to a third embodiment of the invention will be described.

FIG. 14 is a side perspective view which schematically illustrates a sub-carriage 5 in the embodiment, and corresponds to FIG. 8 which illustrates the sub-carriage 5 of the recording apparatus 1 in the first embodiment, and FIG. 11 which illustrates the sub-carriage 5 of the recording apparatus 1 in the second embodiment. In addition, FIG. 15 is a schematic side view of a peripheral portion of the load absorbing unit 42 as a part of the sub-carriage 5 in the embodiment.

In addition, constituent members which are common to those in the first and second embodiments are denoted by the same reference numerals, and detailed descriptions thereof are omitted.

In the recording apparatus 1 in the embodiment, only a configuration of a carriage 6 is different from the recording apparatus 1 in the first and second embodiments.

As described above, the carriage 6 (sub-carriage 5) in the first embodiment is provided with the ejecting unit-driving substrate accommodating unit 20 which accommodates the recording head 7 and the driving substrate 40, and the control substrate accommodating unit 19 which accommodates the control substrate 41. In addition, the carriage 6 (sub-carriage 5) in the second embodiment is provided with the ejecting unit accommodating unit 37 which accommodates the recording head 7, and the driving substrate-control substrate accommodating unit 36 which accommodates the driving substrate 40 and the control substrate 41.

Meanwhile, as illustrated in FIG. 14, the carriage 6 (sub-carriage 5) in the embodiment is provided with the ejecting unit accommodating unit 37 which accommodates the recording head 7, a driving substrate accommodating unit 50 which accommodates the driving substrate 40, and the control substrate accommodating unit 19 which accommodates the control substrate 41. In addition, similarly to the carriage 6 in the first and second embodiments, the fixing portion 21 and the load absorbing unit 42 are provided. For this reason, the recording apparatus 1 in the embodiment can suppress an application of a load to the recording head 7 from the driving substrate 40 side, in the carriage 6 with a configuration of including the ejecting unit accommodating unit 37, the driving substrate accommodating unit 50, and the control substrate accommodating unit 19.

As illustrated in FIG. 14, the driving substrate 40, and connecting portions 52 and 53 (both are connector terminals) are connected using the FFC 22 in the inside of the driving substrate accommodating unit 50. In addition, the control substrate 41 and the connecting portion 38 (connector terminal) in the embodiment are connected using the FFC 22 in the inside of the control substrate accommodating unit 19. In addition, the control substrate accommodating unit 19 and the driving substrate accommodating unit 50 are connected, using the connecting portion 38 on the control substrate accommodating unit 19 side, and a connecting portion 52 on the driving substrate accommodating unit 50 side, and the driving substrate accommodating unit 50 and the ejecting unit accommodating unit 37 are connected, using a connecting portion 53 on the driving substrate accommodating unit 50 side, and the connecting portion 45 on the ejecting unit accommodating unit 37 side.

As illustrated in FIG. 15, the ejecting unit accommodating unit 37 (peripheral portion of load absorbing unit 42) in the embodiment includes the FFC 22 which connects the recording head 7 and the connecting portion 45, and an elastic body 54. The load absorbing unit 42 in the embodiment has a configuration in which it is possible to effectively prevent a load from being applied to the recording head 7 from the driving substrate 40 side, particularly, by having the elastic body 54, and using an elastic body with an appropriate elastic force corresponding to a configuration of the carriage 6 in this manner.

The load absorbing unit 42 in the first and second embodiments also has the same configuration as the load absorbing unit 42 in the embodiment; however, the configuration of the load absorbing unit 42 is not limited, particularly.

Fourth Embodiment (FIG. 16) and Fifth Embodiment (FIG. 17)

Subsequently, recording apparatuses in a fourth embodiment and a fifth embodiment of the invention will be described.

FIG. 16 is a schematic side view of a peripheral portion of a load absorbing unit 42 in the fourth embodiment, and FIG. 17 is a schematic side view of a peripheral portion of a load absorbing unit 42 in the fifth embodiment. FIGS. 16 and 17 correspond to FIG. 15 which illustrates the peripheral portion of the load absorbing unit 42 in the third embodiment.

In addition, constituent members which are common to those in the above described first to third embodiments are denoted by the same reference numerals, and detailed descriptions thereof will be omitted.

In a recording apparatus 1 in the embodiment, only a configuration in the peripheral portion of the load absorbing unit 42 is different from the recording apparatus 1 in the third embodiment.

As illustrated in FIG. 16, in the peripheral portion of the load absorbing unit 42 of the sub-carriage 5 in the fourth embodiment, the recording head 7, and the driving substrate accommodating unit 50 which accommodates the driving substrate 40 are connected, using the FFC 22. In addition, the elastic body 54 is formed between the recording head 7 and the driving substrate accommodating unit 50, and it is a configuration in which it is possible to prevent a load from being applied to the recording head 7 from the driving substrate accommodating unit 50 side (driving substrate 40 side).

In addition, as illustrated in FIG. 17, the load absorbing unit 42 of the sub-carriage 5 in the fifth embodiment includes a movement regulation unit 55 in which play 56 which permits an approach or a separation of a predetermined distance L1 of the driving substrate 40 with respect to the recording head 7 is provided. The load absorbing unit 42 in the embodiment can absorb a physical load which is associated with a positional change in the driving substrate 40 with respect to the recording head 7 using the play 56. For this reason, the load absorbing unit 42 is formed, using such a simple configuration.

The invention is not limited to the above described embodiments, and can be variously modified in the scope of the invention which is described in claims, and it is needless to say that those are also included in the scope of the invention.

REFERENCE SIGNS LIST

1 Recording apparatus (liquid ejecting apparatus);
2 Adhesive belt;
3 Transport mechanism;
4 Recording mechanism
5 Sub-carriage;
6 Carriage;
7 Recording head (ejecting unit);
8 Driving roller;
9 Driven roller;
10*a*, 10*b* Rail;
11*a*, 11*b*, Pipe;
12 Air blowing unit;
13 Collecting unit;
14 Air blowing fan;
15 Suctioning fan;
16 Collecting port;
17 Air blowing fan motor;
18 Suctioning fan motor;
19 Control substrate accommodating unit;
20 Ejecting unit-driving substrate accommodating unit;
21 fixing portion;
22 FFC;
23 Control unit;
24 CPU;
25 System bus;
26 ROM;
27 RAM;
28 Head driving unit;
29 Motor driving unit;
30 Carriage motor;
31 Transport motor;
32 Feeding motor;
33 Winding motor;
34 Input-output unit;
35 PC;
36 Driving substrate-control substrate accommodating unit;
37 Ejecting unit accommodating unit;
38 Connecting portion on control substrate accommodating unit 19 side (connector terminal);
39 Connecting portion on ejecting unit-driving substrate accommodating unit 20 side (connector terminal);
40 Driving substrate;
41 Control substrate;
42 Load absorbing unit;
43 fixing portion;
44 Connecting portion on driving substrate-control substrate accommodating unit 36 side (connector terminal);
45 Connecting portion on ejecting unit accommodating unit 37 side (connector terminal);
46 Relay substrate;
47 Screw;
48 Hole portion;
49 Lower face side of ejecting unit accommodating unit 37;
50 Driving substrate accommodating unit;
51 Upper face side of ejecting unit accommodating unit 37;
52 Connecting portion on driving substrate accommodating unit 50 side (connector terminal);
53 Connecting portion on driving substrate accommodating unit 50 side (connector terminal);
54 Elastic body;
55 Movement regulation unit; and
56 Play.

The invention claimed is:

1. A liquid ejecting apparatus which ejects liquid onto a medium, the liquid ejecting apparatus comprising:

a carriage which includes a control substrate configuring at least a part of a control unit which controls driving of the entire liquid ejecting apparatus, an ejecting unit which ejects the liquid, and a driving substrate which is connected to the control substrate and the ejecting unit, and drives the ejecting unit, wherein the carriage is provided with a load absorbing unit which absorbs a physical load with respect to the ejecting unit from the driving substrate side, the load absorbing unit being interposed between the ejecting unit and the driving substrate.

2. The liquid ejecting apparatus according to claim 1, wherein the carriage includes an ejecting unit-driving substrate accommodating unit which accommodates the ejecting unit and the driving substrate, and a control substrate accommodating unit which accommodates the control substrate.

3. The liquid ejecting apparatus according to claim 1, wherein the carriage includes an ejecting unit accommodating unit which accommodates the ejecting unit, and a driving substrate-control substrate accommodating unit which accommodates the driving substrate and the control substrate.

4. The liquid ejecting apparatus according to claim 1, wherein the carriage includes the ejecting unit accommodating unit which accommodates the ejecting unit, a driving substrate accommodating unit which accommodates the driving substrate, and a control substrate accommodating unit which accommodates the control substrate.

5. The liquid ejecting apparatus according to claim 1, wherein the load absorbing unit includes an elastic body.

6. The liquid ejecting apparatus according to claim 1, wherein the load absorbing unit includes a movement regulating unit which is provided with play which permits an approach or a separation of the driving substrate with respect to the ejecting unit by a predetermined distance.

7. The liquid ejecting apparatus according to claim 1, wherein the carriage includes a plurality of ejecting units each of which ejects the liquid, and a plurality of driving substrates each of which is connected to the control substrate and each of the plurality of ejecting units in one-to-one correspondence, and drives the ejecting units, wherein the carriage is provided with a plurality of load absorbing units each of which absorbs a physical load with respect to the ejecting units from the driving substrates side.

8. The liquid ejecting apparatus according to claim 1, wherein the driving substrate extending along a thickness direction of the medium, the liquid ejecting apparatus further comprising a fixing portion which is connected to the carriage and fixes the driving substrate from an upper side of the driving substrate in the thickness direction of the medium.

* * * * *